US010667572B1

(12) United States Patent
Gagnon, Jr.

(10) Patent No.: US 10,667,572 B1
(45) Date of Patent: Jun. 2, 2020

(54) PROTECTIVE HELMET HAVING FORCE IMPACT DISTRIBUTION

(71) Applicant: Dennis P Gagnon, Jr., Miramar Beach, FL (US)

(72) Inventor: Dennis P Gagnon, Jr., Miramar Beach, FL (US)

( * ) Notice: Subject to any disclaimer, the term of this patent is extended or adjusted under 35 U.S.C. 154(b) by 0 days.

(21) Appl. No.: 15/844,582

(22) Filed: Dec. 17, 2017

Related U.S. Application Data

(63) Continuation-in-part of application No. 14/725,817, filed on May 29, 2015, now abandoned.

(51) Int. Cl.
*A42B 3/06* (2006.01)

(52) U.S. Cl.
CPC ..... *A42B 3/062* (2013.01)

(58) Field of Classification Search
CPC ..... A42B 3/062; A42B 3/063; A42B 3/065; A42B 3/00
USPC ..... 2/412, 411, 410
See application file for complete search history.

(56) References Cited

U.S. PATENT DOCUMENTS

2011/0047680 A1* 3/2011 Hoying ..... A42B 3/069 2/414
2016/0157544 A1* 6/2016 Ning ..... A42B 3/065 2/411

* cited by examiner

*Primary Examiner* — Anna K Kinsaul
*Assistant Examiner* — F Griffin Hall
(74) *Attorney, Agent, or Firm* — Peter Loffler

(57) ABSTRACT

A helmet has a shell, the shell having an outer surface and an inner surface such that at least a portion of the outer surface is formed as a series of adjoining polygon shaped faceted regions that help distribute any force impacted on such regions across a relatively large portion of the shell. The faceted regions may be flat, curvedly contoured, or a combination thereof and extend through to the inner surface of the shell. The middle section has the faceted regions while the crown and the lower section may also have the faceted regions or may be contoured as is typical for a traditional helmet of that style.

12 Claims, 5 Drawing Sheets

PROTECTIVE HELMET HAVING FORCE IMPACT DISTRIBUTION

This application is a Continuation-in-Part of U.S. patent application Ser. No. 14/725,817 filed on May 29, 2015, which application is incorporated herein by reference in its entirety.

BACKGROUND OF THE INVENTION

1. Field of the Invention

The present invention relates to a sports or other type of head protecting helmet that has an architecture that helps distribute an impact force occasioned onto the helmet across a relatively large surface area of the helmet in order to reduce the possibility of a user of the helmet suffering a concussion and/or head related injury, including micro-traumatic brain injury.

2. Background of the Prior Art

Concussions are a type of brain injury that result when the brain is violently jarred, such as being hit in a contact sport including football, boxing or hockey, suffering a fall, being in a vehicle accident, etc. A concussion can cause headaches, drowsiness, loss of consciousness, loss of memory, nausea and vomiting, confusion, loss of balance, and various other problems. The effects from suffering a concussion can be relatively short term if the concussion is mild or can be long term or even permanent if the concussion is more severe or a person suffers multiple concussions. In recent years, much focus has been devoted to the study of concussions fueled in part by former football players who are reporting that they are suffering serious adverse effects long after getting off of the grid iron. Many former players are reporting having memory loss, suffering from depression or having chronic traumatic encephalopathy among other problems, years or even decades after ending their playing careers. Some have attributed suicides by former football players to the concussions they suffered on the field. Scientists are just beginning to understand the elaborate and complex effects of concussions on the human brain with much study remaining to be undertaken.

To address these concerns with respect to concussions, sports leagues, including the National Football League and the National Hockey League have been changing their respective rules to try and minimize certain types of hits on players, which hits are more likely to cause concussions relative to other types of hits. Such rules include the prohibition on hits to the helmet as well as leading with the helmet in delivering a hit While many of the rule changes have been deemed effective, these sports remain dynamic, fast moving, and violent so that concussions continue to occur.

Equipment manufacturers have also been working on designing equipment, especially helmets, that better help protect the player by making the helmets stronger as well as allowing the helmet to distribute a blow to the helmet over a larger area of the helmet so that the wearer's head is better able to absorb a hit and thereby reduce the potential for a concussion or reduce the severity if a concussion is suffered. The effort to help spread an impact force on the helmet has focused on the inner liners of the helmet with equipment designers turning to force distribution fabric as a cushioning and spacing material so that a force directed from the outer shell into the interior of the helmet is spread over a larger area by the force distribution fabric and thus the force is spread over a larger area of the wearer's head relative to standard cushioning. The focus on the outer shell of the helmet has been to strengthen and harden the shell via materials science in order to reduce the amount of energy passed through to the interior of the helmet when the shell is impacted.

It is believed that the rule changes mentioned and the changes to equipment design have had a positive impact on the issue of concussions experienced by players of contact sports, however, more can be done.

SUMMARY OF THE INVENTION

The protective helmet having force impact distribution of the present invention addresses the aforementioned needs in the art by providing an outer shell of a helmet (including various sports helmets, motorcycle helmets, construction helmets, etc.) with force distribution capabilities so as to help further reduce the potential for brain injury from a blow to helmet, complementing the other advances being made to helmet protection technology. The protective helmet having force impact distribution changes the geometry of the outer shell of the helmet without the need to change the material of the outer shell (current state of the art material can continue to be used) and without the need to substantially alter the inner cushioning architecture or strategy of the helmet. The protective helmet having force impact distribution is of relatively simple design and construction, being produced using standard manufacturing techniques, so as to make the present invention relatively inexpensive to produce so as to make the helmet economically attractive to potential consumers of the device. The protective helmet having force impact distribution is worn and used in standard fashion.

The protective helmet having force impact distribution of the present invention is comprised of a helmet body that has an outer shell. The outer shell has an overall outer surface and an overall inner surface and has a crown, a lower section, and a middle section therebetween, each of these sections comprising approximately ⅓ of the overall sectioning of the helmet body, more or less. At least a portion of the outer surface is formed as a series of interconnected faceted polygon-shaped regions. Each faceted region has its an outer surface (part of the overall outer surface proper of the outer shell) that has a convex contour and each faceted region also has a corresponding inner surface (part of the overall inner surface proper of the outer shell) that has a concave contour that corresponds to the convex contour of the outer surface of the faceted region so that each of the interconnected polygon-shaped faceted regions extend through the outer shell between the overall outer surface and the overall inner surface and the outer shell has a constant thickness throughout, at least in the portions that have the interconnected polygon-shaped faceted regions. The portion of the outer shell that has the faceted regions may be the middle section or may be the lower section or the crown or some combination thereof, with the faceted regions located on at least the middle section. The middle section is the prime area for force impacts on the helmet so that middle area of the helmet is the principle area for location of the faceted regions. Although the faceted regions can also be deployed on the crown and/or the lower section of the outer shell in order to maximize protection, a tradeoff can be achieved by leaving the faceted regions off of the crown and/or lower section so that such section(s) have their normal geometry. Such a trade-off can result in production costs being lower and decal placement of team logos can be more easily and effectively achieved with a greater aesthetic appeal. Such logo or decal placement, although having no mechanical functional effect on the helmet, is very important in team sports, especially sports such as football where the helmet is constantly worn on the field of play. Decals, such as the team logos, give the players a sense of team unity and individual decals, which are given by a coach to an individual player for a particular achievement, typically in the college football ranks, give a player a sense of pride and encourage that player and others to strive for excellence. By having portions of the helmet with a "normal" look, allows for overall better aesthetics of the helmet, which is a positive for players and fans alike.

BRIEF DESCRIPTION OF THE DRAWINGS

Similar reference numerals refer to similar parts throughout the several views of the drawings.

DESCRIPTION OF THE PREFERRED EMBODIMENT

Figure 1:
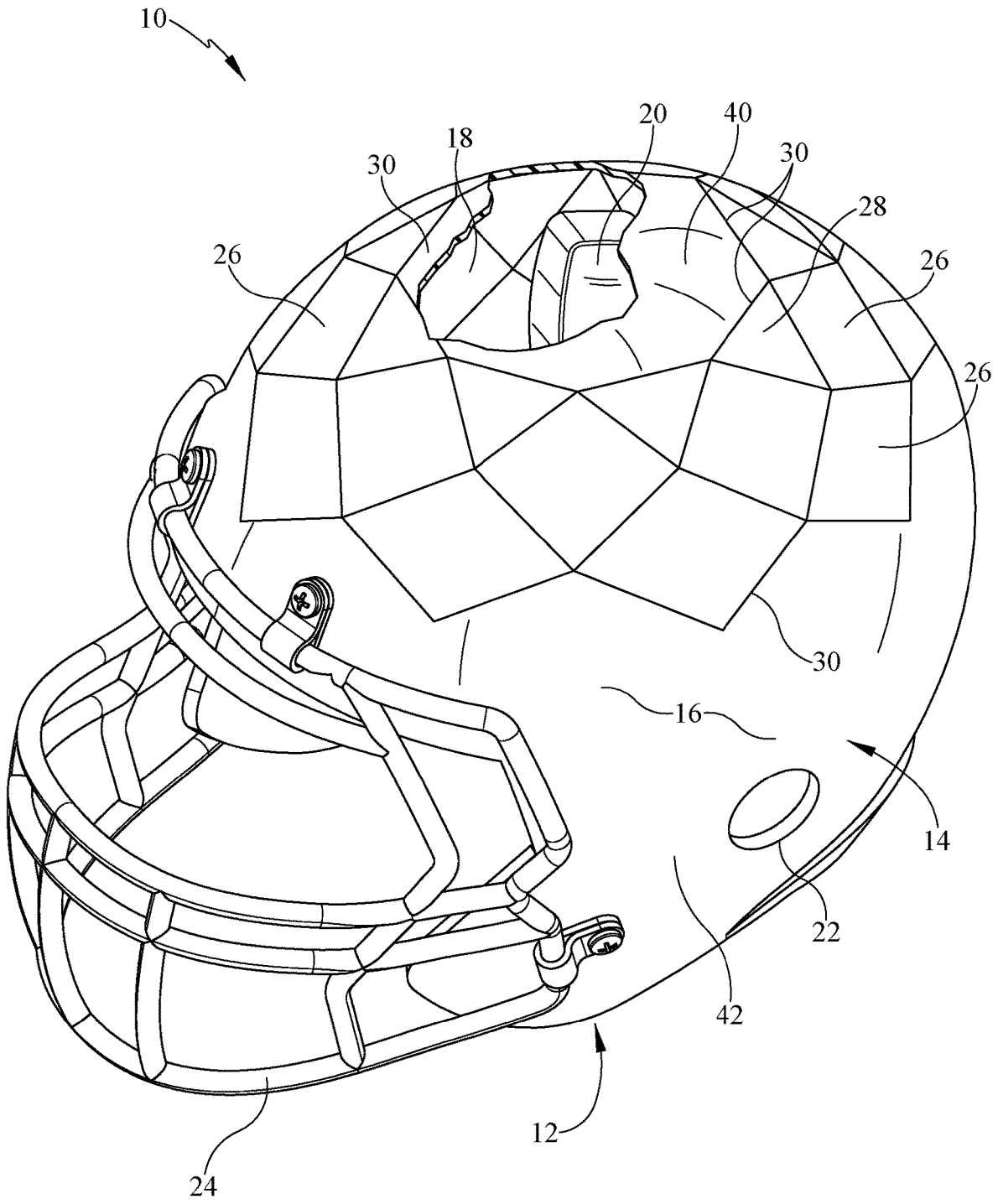
FIG. 1 is a perspective view, partially cutaway, of the protective helmet having force impact distribution of the present invention wherein the faceted regions are relatively flat and are located on the middle section of the helmet.

Referring now to the drawings, it is seen that the protective helmet having force impact distribution of the present invention, generally denoted by reference numeral 10, is comprised of a helmet body 12 that is formed from an outer shell 14 that has an overall outer surface 16 and an overall inner surface 18. Cushioning material 20 of appropriate material selection, design, and layering, may be located within interior of the helmet body 12 abutting and possibly attached to the inner surface 18 of the outer shell 14 as is well known in the art of sports helmets and other type of protective helmets. The outer shell 14 is formed from any appropriate material such as polycarbonate layered with other material, such as aluminum, foam, leather, etc.

The helmet body 12 may also have the typical ear holes 22 disposed in the outer shell 14 and a face mask 24 attached to the outer shell 14, if appropriate for the particular sport or activity for which the helmet is designed, as is well known in the art, as well as other appropriate items such as a sun visor (bill), etc.

Figure 2:
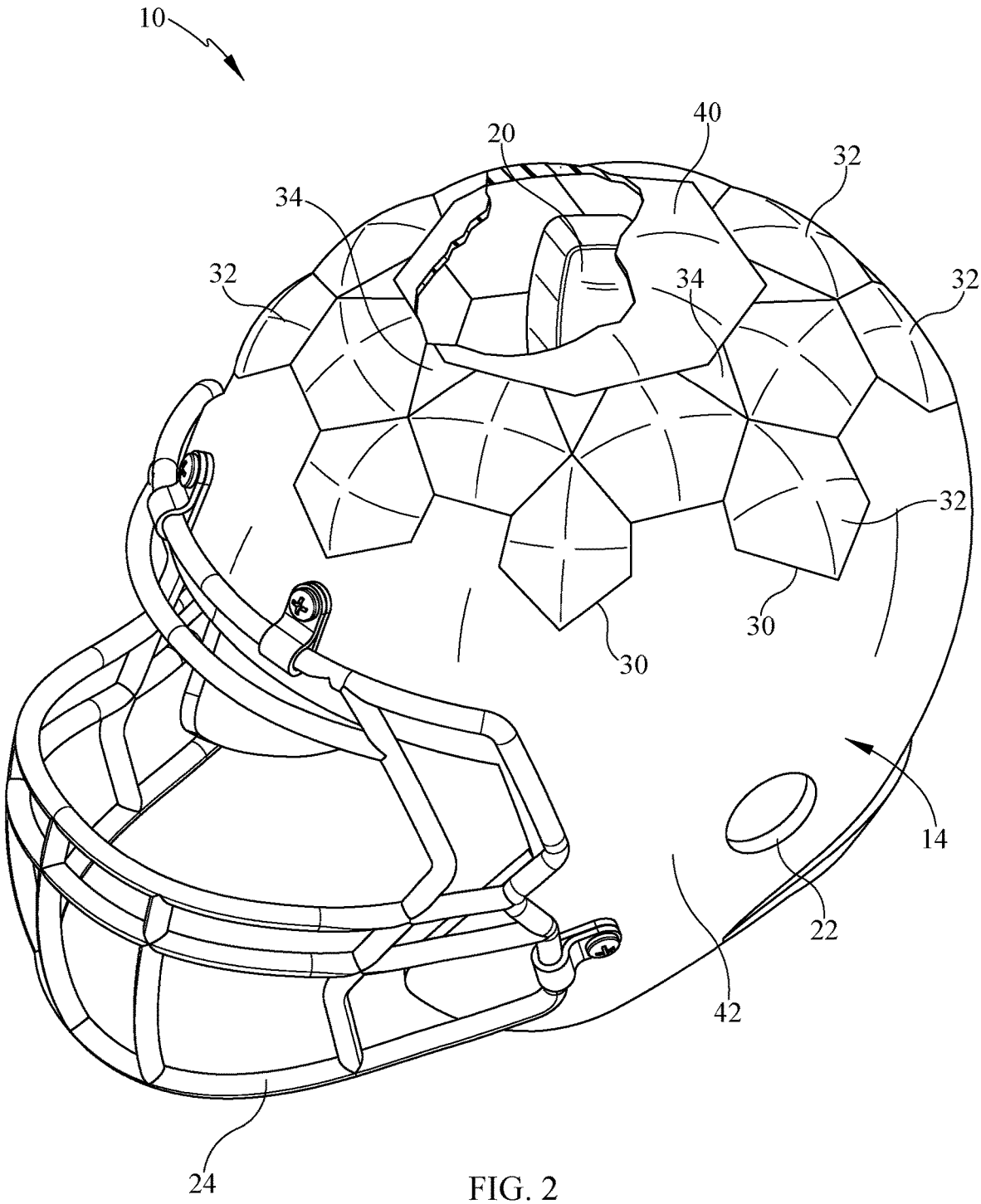
FIG. 2 is a perspective view, partially cutaway, of the protective helmet having force impact distribution using a different faceted region geometry.

As seen, instead of having a rounded outer surface, the outer shell 14 has at least a portion of its outer surface 16 formed as a series of connected faceted regions of various geometry such as diamond shaped regions 26 possibly with triangle shaped regions 28 at the outer boundary (the outer boundary being the straight edges 30 that meet any portion of the outer shell 14 that does not have the faceted regions) as seen in FIG. 1, hexagon shaped regions 32 possibly with arrowhead shaped regions 34 as seen in FIG. 2, or triangle (possibly isosceles) shaped regions 36 with a different type of triangle (equilateral) shaped region 38 at the boundary. The outer surface of each of the individual facets of whatever shape, is slightly convex. The outer shell 14 of the helmet body that has the connected faceted regions has a relative constant thickness so that, as seen in the figures, the inner surface 18 of the outer shell 14 also has the faceted regions corresponding to the faceted regions on the outer surface 16 of the outer shell 14, with the facets on the inner surface 18 of the outer shell being slightly concave in order to match the convex contouring of the outer surface of the particular faceted region. By utilizing a constant thickness of the faceted regions of the outer shell 14, impacts on the outer shell 14 allow relatively smooth deflection of forces impacted onto the outer surface 16 of the outer shell 14 with the slight concavity of the outer surface of each faceted region assisting in such force deflection.

Figure 3:
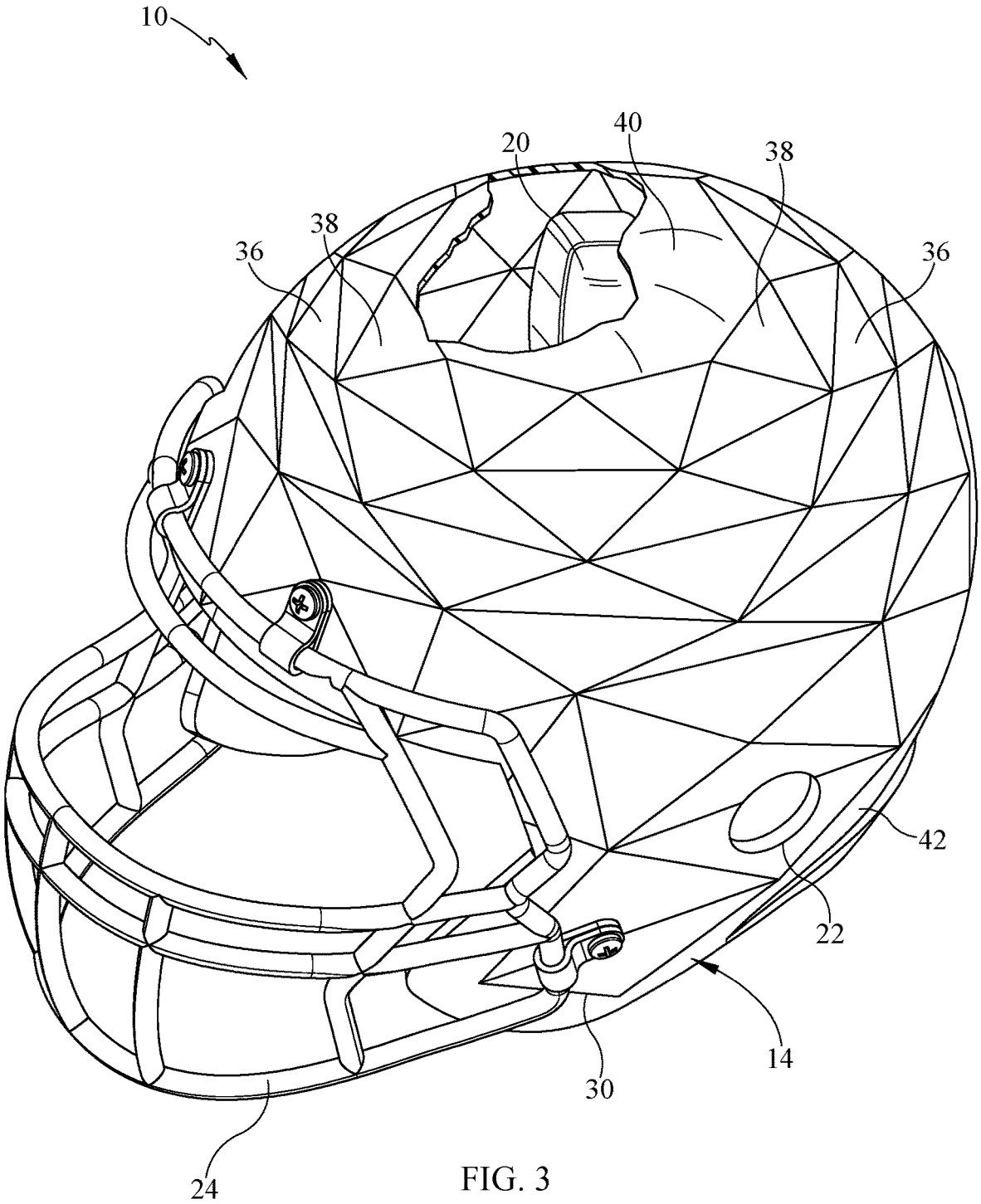
FIG. 3 is a perspective view, partially cutaway, of the protective helmet having force impact distribution employing yet another faceted region geometry and wherein the faceted regions cover both the middle section and the lower section of the outer shell of the helmet.
Figure 4:
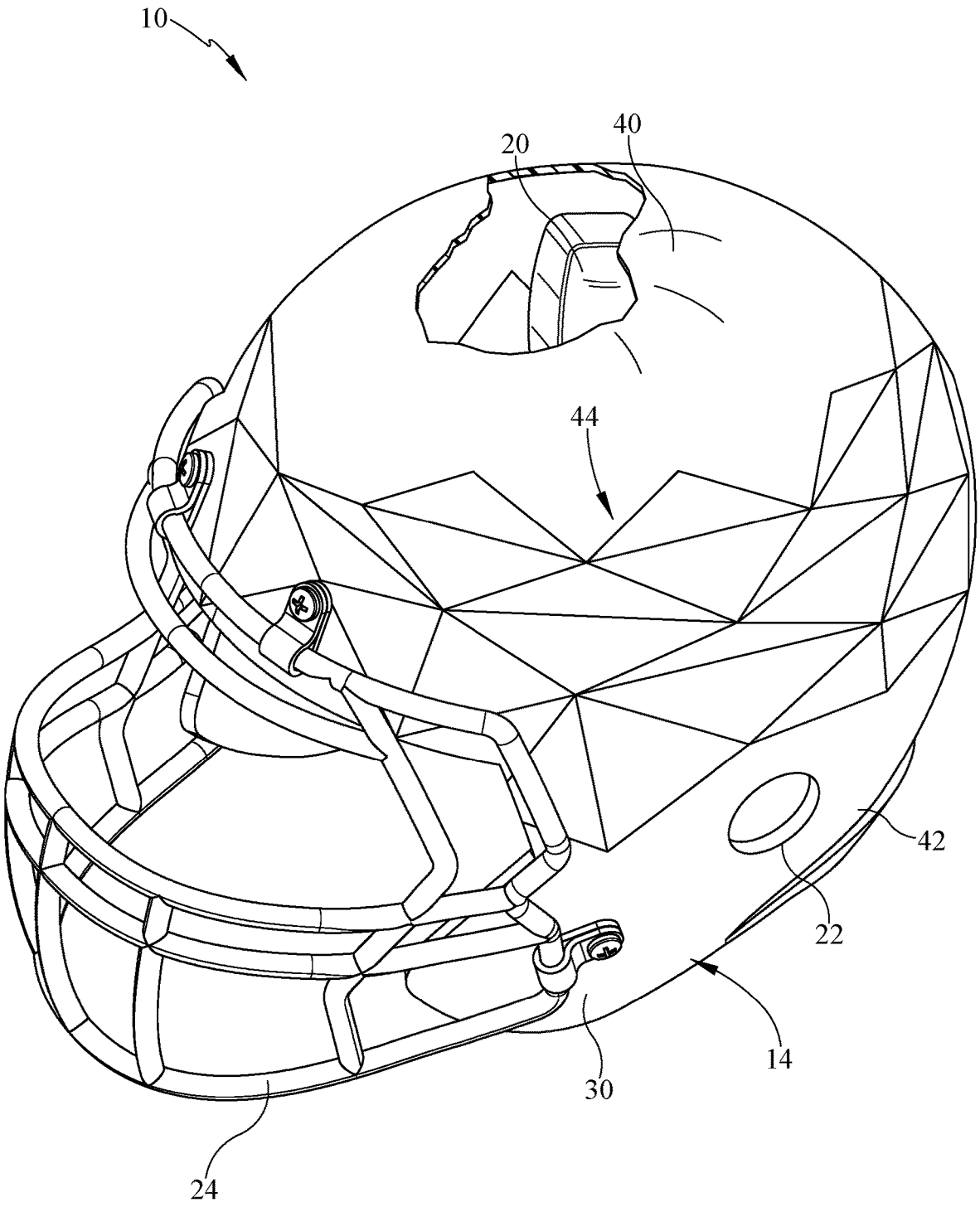
FIG. 4 is a perspective view of the protective helmet having force impact distribution wherein the middle section of the outer shell of the helmet is faceted and the crown and the lower section of the outer shell are not faceted.
Figure 5:
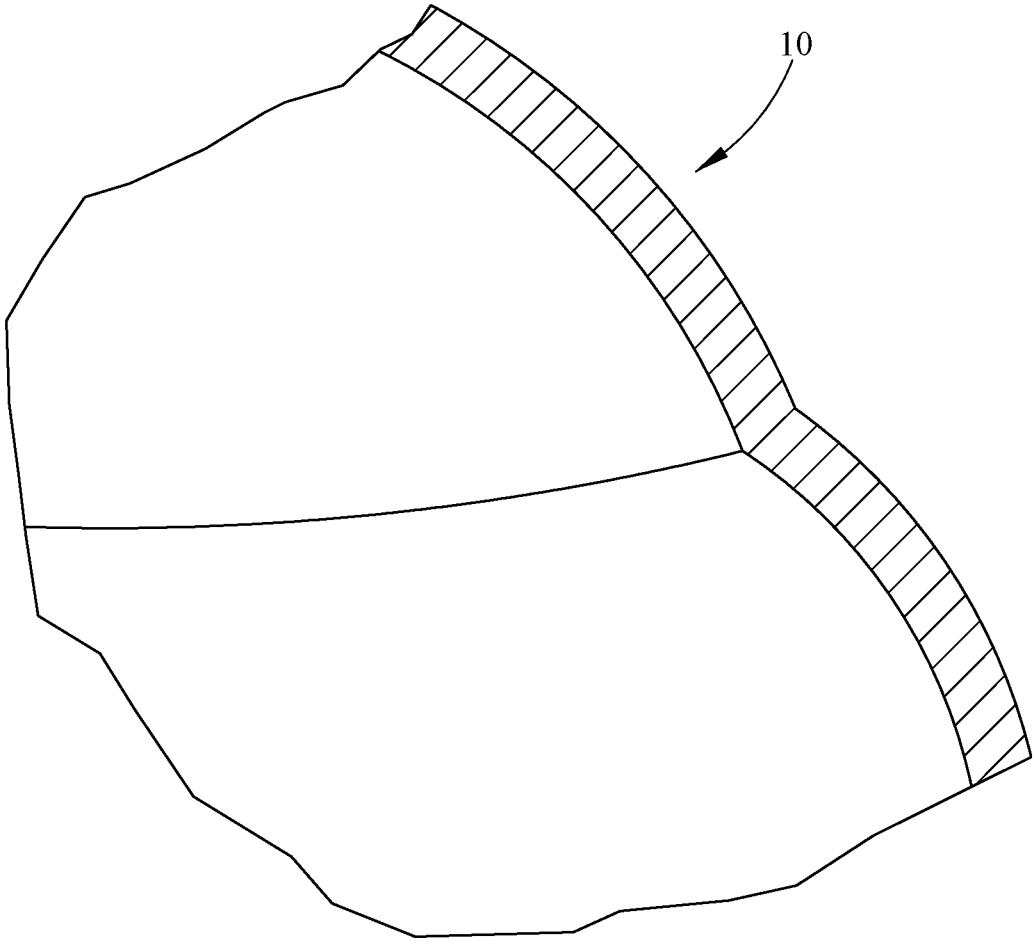
FIG. 5 is a sectioned portion of the protective helmet having force impact distribution illustrating the curved contouring of the individual facets that form at least a portion of the outer shell of the helmet.

The faceted regions can comprise virtually all of the outer surface 16 of the shell 14 or, as seen in FIGS. 1 and 2, can be confined to the crown 40, roughly upper third of the outer shell 14, such that the middle section 44 and the lower section 42 of the outer shell 14 have the more traditional shape of a sports helmet (or other type of helmet onto which the present invention is implemented). Of course, as seen in FIG. 3, substantially the entire outer shell 14 can be covered with the faceted regions. As seen in FIG. 4, the middle section 44, the prime area of focus of protection of the helmet, can have the faceted regions with the crown 40 and the lower section void of the faceted regions. The cushioning material 20 can be configured so that its outer surface—the surface that abuts the inner surface 18 of the outer shell 14 is appropriately contoured to match the contouring of the inner surface 18 of the outer shell 14 so that the cushioning material 20 fits snug and tight within the outer shell 14 and is secured appropriately therein, so that the uneven nature of the inner surface 18 of the outer shell 14 is not felt by the wearer of the helmet in any appreciable manner.

The size of each type of faceted region (e.g., diamond shaped faceted region 26) may but need not be of the same size. Additionally, other shapes of faceted regions can be used and more than two types of faceted regions can be employed on a given shell 14.

When a force is imparted onto one or more faceted regions on the outer surface 16 of the outer shell 14, the force is spread or transferred to many of the adjoining faceted regions and possibly to a portion of the non-faceted portion(s) of the outer shell 14 (if the outer shell is so designed) so as to spread the force over a relatively larger surface area so that the force that is transferred through the outer shell 14 into the interior of the helmet body 12 is spread over a relatively large surface area thereby reducing the risk injury to the wearer.

In essence, the present invention reduces the force imparted to the helmet wearer by increasing impact deflection while reducing the reflection.

While the invention has been particularly shown and described with reference to an embodiment thereof, it will be appreciated by those skilled in the art that various changes in form and detail may be made without departing from the spirit and scope of the invention.

I claim:

1. A helmet configured to be worn on a human head, the helmet comprising a helmet body that has an outer shell having a first overall outer surface and a first overall inner surface and has a crown, a lower section, and a middle section therebetween, such that at least a portion of the first overall outer surface is formed as a faceted region made from a series of adjoining facets and such that the adjoining facets extend through the outer shell to the first overall inner surface and such that each facet has a second outer surface that is a subset of the first overall outer surface and that has a convex contour and each facet has a second inner surface that is a subset of the first overall inner surface and that has a concave contour that corresponds to the convex contour of the second outer surface of the particular facet.

2. The helmet as in claim 1 wherein the portion of the outer shell having the faceted region is the middle section.

3. The helmet as in claim 2 wherein the portion of the outer shell having the faceted region further includes the crown.

4. The helmet as in claim 2 wherein the portion of the shell having the faceted regions further includes the crown and excludes the lower section.

5. The helmet as in claim 1 wherein the portion of the shell having the faceted regions is the middle section and excludes the lower section.

6. The helmet as in claim 1 wherein the outer shell has a constant thickness.

7. A helmet configured to be worn on a human head, the helmet comprising a helmet body that has an outer shell having a first overall outer surface and a first overall inner surface and has a crown, a lower section, and a middle section therebetween, such that at least a portion of the first overall outer surface is formed as a series of adjoining polygon-shaped facets and such that the adjoining polygon-shaped facets extend through the helmet body to the first overall inner surface and such that each facet has a second outer surface that is a subset of the first overall outer surface and that has a convex contour and each facet has a second inner surface that is a subset of the first overall inner surface and that has a concave contour that corresponds to the convex contour of the second outer surface.

8. The helmet as in claim 7 wherein the portion of the outer shell having the faceted region is the middle section.

9. The helmet as in claim 8 wherein the portion of the outer shell having the faceted region further includes the crown.

10. The helmet as in claim 8 wherein the portion of the shell having the faceted regions further includes the crown and excludes the lower section.

11. The helmet as in claim 7 wherein the portion of the shell having the faceted regions is the middle section and excludes the lower section.

12. The helmet as in claim 7 wherein the outer shell has a constant thickness.

* * * * *